US005584435A

United States Patent [19]

Lind

[11] Patent Number: 5,584,435

[45] Date of Patent: Dec. 17, 1996

[54] BELL ATOMIZER WITH AIR/MAGNETIC BEARINGS

[75] Inventor: Bjorn Lind, Billdal, Sweden

[73] Assignee: E. Fischer AG, Switzerland

[21] Appl. No.: 332,106

[22] Filed: Oct. 31, 1994

Related U.S. Application Data

[63] Continuation-in-part of Ser. No. 52,390, Apr. 23, 1993, abandoned.

[51] Int. Cl.[6] ..... B05B 3/10

[52] U.S. Cl. ..... 239/73; 239/223

[58] Field of Search ..... 239/223, 224, 239/263, 71, 73, 264; 73/502, 506, 518, 521; 384/99, 109, 194, 446, 102

[56] References Cited

U.S. PATENT DOCUMENTS

| | | | |
|---|---|---|---|
| 3,741,018 | 6/1973 | Katz | 73/500 |
| 3,938,863 | 2/1976 | Victor et al. | 384/107 |
| 4,214,708 | 7/1980 | Lachia | 239/223 X |
| 4,467,968 | 8/1984 | Morishita et al. | 239/703 |
| 4,700,890 | 10/1987 | Takouchi et al. | 239/223 X |
| 4,811,906 | 3/1989 | Prus | 239/703 |
| 4,970,422 | 11/1990 | Lind | 310/90 |

FOREIGN PATENT DOCUMENTS 61-025742 4/1986 Japan .

OTHER PUBLICATIONS

"Magnetic Bearing" IBM Technical Disclosure Bulletin, vol. 3 No. 1 Jun. 1960 W. Brandenberg.

*Primary Examiner*—Kevin P. Weldon

*Attorney, Agent, or Firm*—Ostrolenk, Faber, Gerb & Soffen, LLP

[57] ABSTRACT

A spray painting nozzle designed as a spindle supporting a gas bearing and incorporating a stationary part and a part rotatably supported in relation thereto, which latter carries a rotatable spray painting cup and being adapted to be driven by a drive unit, whereby the spray painting cup is equipped with a supporting system comprising mutually plane-parallel bearing surfaces formed in the stationary and in the rotatable parts, and with a supply of a gaseous medium for causing a slot generated as an axial gas bearing therebetween, the rotatable part being radially guided by a magnetic force for centering the rotatable part in relation to the stationary part, the supporting system further being equipped with symmetrically provided holder magnets for limitation of the size of the slot, and where for supply of spray medium to the spray painting cup, there is provided a supply path extending through the plane of the gas bearing.

9 Claims, 3 Drawing Sheets

BELL ATOMIZER WITH AIR/MAGNETIC BEARINGS

This is a continuation-in-part of application Ser. No. 08/052,390, filed Apr. 23, 1993 now abandoned.

BACKGROUND OF THE INVENTION

1. Field of the Invention

The present invention refers to a spray painting nozzle designed as a spindle supporting a gas bearing and of the type provided with a rotatable spray painting cup, referred to as a spray painting bell.

Such a spray painting nozzle incorporates a painting cup rotatably supported by a stationary part, and equipped with a number of openings provided in the inner surface of the cup, through which openings the medium to be sprayed is fed out during operation.

In order to give the medium fed out a desired dispersion, the cup must rotate at a very high speed, and for this reason very high demands are put on the supporting and driving thereof.

2. Description of the Related Art

It is known to use gas bearings for axial supporting of other types of rotating systems, whereby a gas is introduced under pressure between the mutually plane-parallel surfaces in the stator and rotor for creating a thin slot between the surfaces. This type of supporting gives low friction and good operational behavior at very high speeds. The size of the bearing slot is preferably limited by magnetic forces.

U.S. Pat. No. 4,467,968 refers to a rotary-type electrostatic spray painting device having a rotary shaft supported in radial and axial air bearings and being centered by magnetic forces. The spray cup-shaped head of the device is fixed to the front end of the rotary shaft, and the medium to be sprayed is introduced in the spray head from the side via a nozzle affixed to the non-rotary part of the device and projects laterally from the side into a chamber in the spray head. With this design, the supply of paint sidewise into the spray head, which rotates at a very high speed, will cause problems and may cause unbalance.

U.S. Pat. No. 4,811,906 relates to a spray painting nozzle in which a rotor shaft contained in a longitudinal cavity is suspended in an unstable position by two sets of magnets spaced axially along the rotor shaft. A two-sided gas bearing is used to stabilize the system. This nozzle is very complex and has problems, especially the long design shaft, including wasted paint, and susceptibility to small torsional imbalances.

SUMMARY OF THE INVENTION

The present invention overcomes the problems of the prior art noted above by providing a spray painting nozzle which can be driven at very high speeds (up to 100,000 rpm) without problems regarding the supply of the medium to be sprayed, unbalance and the like. The spray painting nozzle has a spindle supporting a gas bearing incorporating a stationary part, and a part rotatably supported in relation thereto which carries a rotatable spray painting cup adapted to be driven by a drive unit. The spray painting cup is equipped with a supporting system comprising mutually plane-parallel bearing surfaces formed in both the stationary and the rotatable parts. A supply of a gaseous medium is provided which generates a slot as an axial gas bearing between the surfaces. The rotatable part is radially guided by magnetic force for centering the rotatable part in relation to the stationary part. The supporting system further incorporates symmetrical holder magnets which pre-load the rotatable part onto the stationary part for limiting the size of the slot created by the gas bearing. To supply the spray medium to the spray painting cup, a supply path extends through the stationary part of the gas bearing.

Other features and advantages of the present invention will become apparent from the following description of the invention which refers to the accompanying drawings.

BRIEF DESCRIPTION OF THE DRAWINGS

Hereinafter the invention will be further described with reference to embodiments shown in the accompanying drawings.

DETAILED DESCRIPTION OF THE PREFERRED EMBODIMENTS

Figure 1:
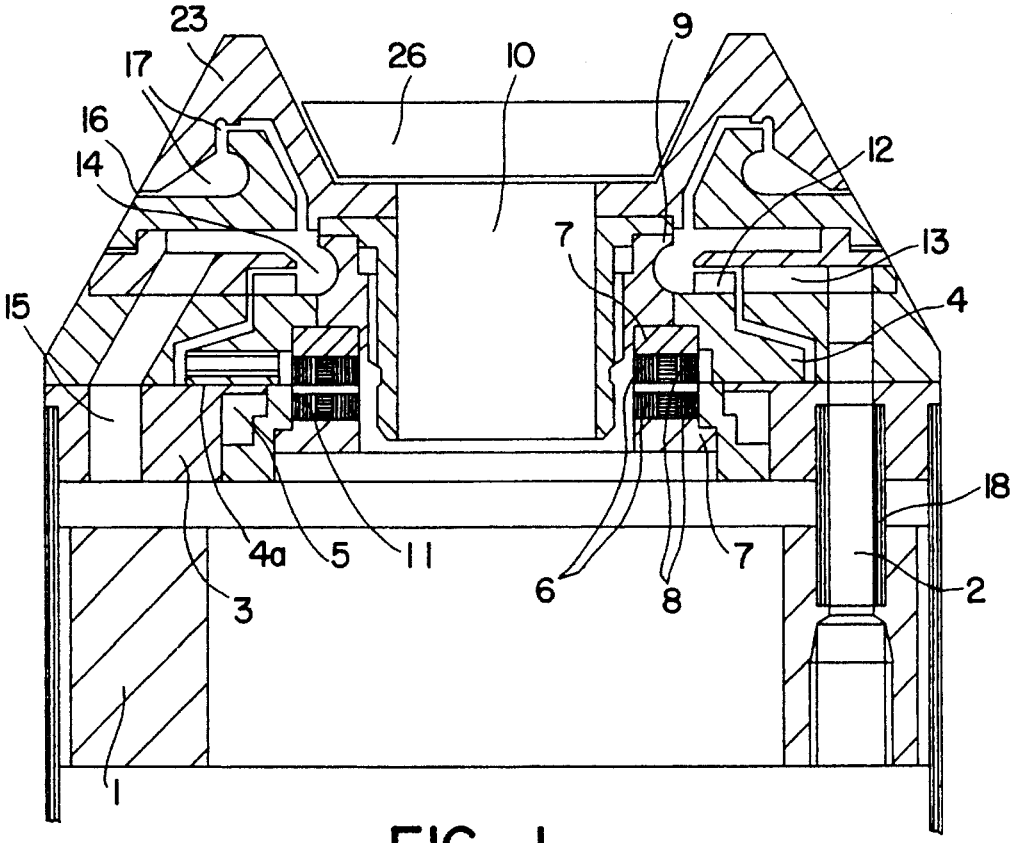
FIG. 1 shows in a vertical cross-section a spray painting nozzle according to the invention.

FIG. 1 shows schematically in cross-section an embodiment of a gas-supported spindle according to the present invention which incorporates a supporting structure 1 with a number of channels 2 for pressurized gas, preferably dried, compressed air. Whereas the drawing shows only one such channel, the structure may incorporate, e.g., six such channels, arranged spaced apart along a substantially round path. Preferably, the channels are spaced asymmetrically to reduce harmonic oscillations and other related problems. The supporting structure 1 carries a lower, non-rotatable part 3 of a gas bearing, and an upper, rotating part 4 which has a bearing surface which is plane-parallel to a bearing surface of the stationary lower part 3. One of the not-shown gas channels opens in an annular chamber 5, provided in the stationary bearing part, and communicating via not-shown openings with the plane **4*a* of the gas bearing. When the pressurized gas is pressed in between the bearing surfaces, these surfaces are urged apart axially such that a thin slot is created between the bearing surfaces at the plane 4*a***.

Figure 6:
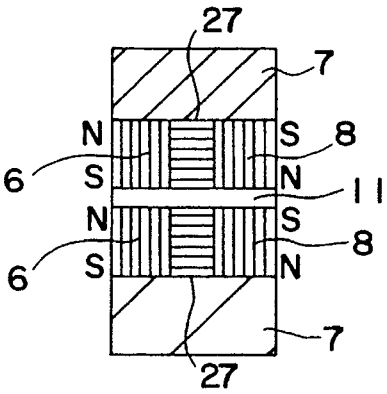
FIG. 6 shows a cross-sectional detail of the magnets and short-circuiting rings used according to the invention.

Adjacent to the bearing surfaces, mutually attracted pairs of magnets 6 are arranged annularly and symmetrically about a center of rotation. A second set of mutually attracted pairs of magnets 8 is positioned similarly outside magnets 6, the two sets preferably being separated by a non-magnetic spacer 27. The respective sets of magnets 6 and 8, magnetized in an axial direction, are magnetically interconnected by means of magnetic yokes or short-circuiting rings 7, which are formed of a magnetically conductive material. Preferably, the magnetic poles are arranged as shown in detail in FIG. 6. Accordingly, a continuous, closed magnetic field is generated by the two, interconnected sets of magnets, thereby increasing the magnetic force. The magnetic force preferably is sufficiently strong so as not to be overcome by the gas pressure creating the thin slot, thereby preventing rotor 4 from being functionally separated from stationary part 3. Magnet pairs 6 and 8 also act to center the rotor, which rotates about a mass center above a critical speed. An air gap 11 is provided between each of the two sets of magnets to prevent direct contact therebetween.

The rotating bearing part 4 is connected to an internally threaded rotor part 9, into which is screwed or snapped a detachable outer rotor part 23 having an internal, central axial through-channel which functions as a supply path 10 for the medium to be sprayed, outer rotor part 23 acts as a holder for a spray painting cup 26. The cup 26 may alternatively be a part integral with the outer rotor part.

In the embodiment shown in FIG. 1, the rotating bearing part 4 is equipped with structures 12 acting as turbine blades, and the stationary part 3 is provided with at least one, and preferably several circumferentially arranged turbine inlets 13, each of which communicates with the gas channels 2. Alternatively, the internally threaded rotor part 9 may be equipped with turbine blade structures 12.

The stationary part 3 is provided with internally opening exhaust channels 14, 15 for the driving gas of the turbine blades. The stationary part 3 and the detachable rotor part 23 are designed to form a slot-shaped outlet 16 with a sealing labyrinth 17 between them.

In the embodiment shown in FIG. 1, the channels 2 for supply of gas to the bearing, to turbine blades, and possibly also to a brake device (shown in one embodiment with respect to FIG. 5) are arranged to extend through damping means 18. Accordingly, damping means 18 are tubes made of a resilient elastic material, for example, rubber. Damping means 18 provide vibration-damping and motion-limiting suspension of the stationary part 3 relative to the supporting structure 1.

Figure 2:
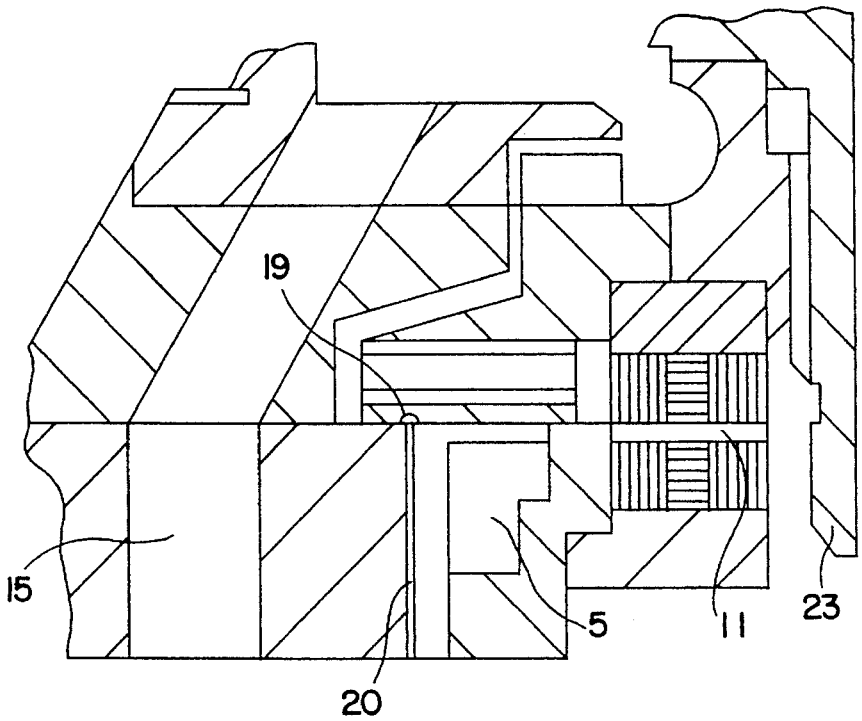
FIG. 2 is an enlarged part view of the nozzle according to FIG. 1.

FIG. 2 shows in larger scale a detail from FIG. 1, whereby in one of the bearing parts, here in the rotating part 4, there is provided a small chamber 19, open towards the bearing surface. During operation, the small chamber will obtain the same over-pressure as that prevailing between the bearing surfaces. In the other bearing part, in the example shown the stationary part, there is provided a thin channel 20 communicating with the surroundings. The channel is positioned such that the chamber 19 will be situated just in front of the thin channel 20 during the rotation of the rotating bearing part, as shown, once per rotation over 360°, whereby the pressure in the chamber rapidly reduces. The resulting pressure shock can be detected, for example, at the end of the channel facing away from the chamber, as an indication for recording the current rotational speed by means of a not-shown device, e.g. a microphone, a pressure sensor, or the like.

Figure 3:
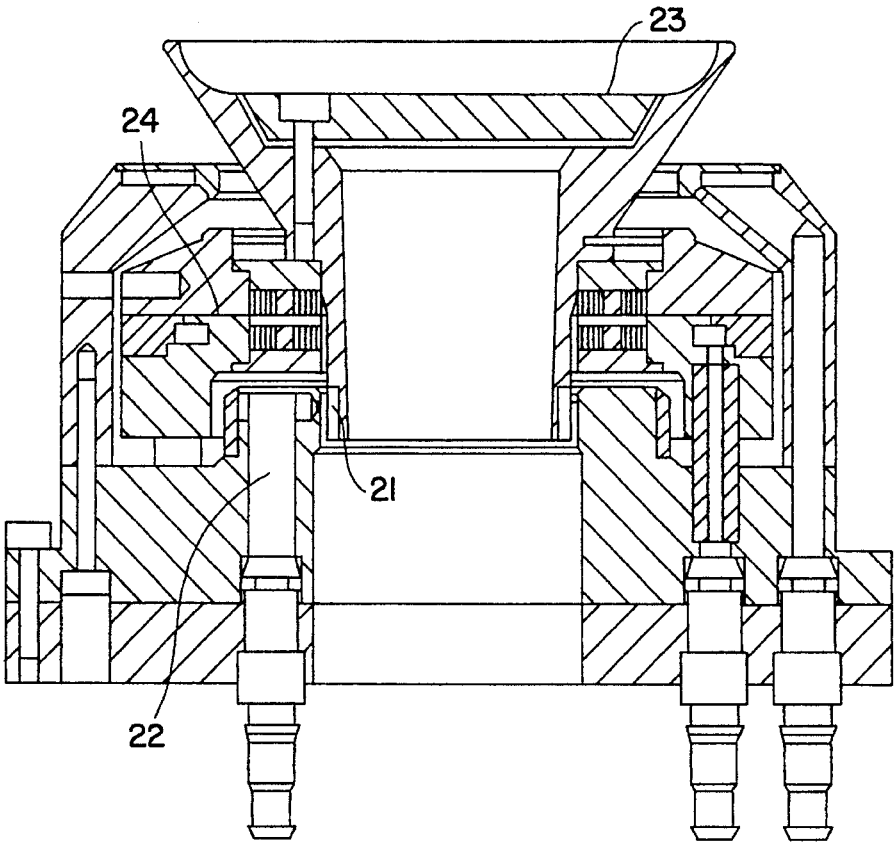
FIG. 3 is a cross-section corresponding to FIG. 1 through a second embodiment of the invention.

In the embodiment of the spray painting nozzle shown in FIGS. 1 and 2, the turbine blades 12 are provided adjacent the forward end of the nozzle, i.e. after the gas bearing and the stacks of magnets, but as shown in an alternative embodiment in FIG. 3, the turbine blades 21 and air inlets 22 optionally may be arranged at the rearward part of the rotating part 23, i.e., before the gas bearing 24 and the stack of magnets. It is also possible, optionally, to drive the rotating part by letting it be the rotor of an electro-motor, the stator of which is provided in or forms a portion of the stationary part.

Figure 4:
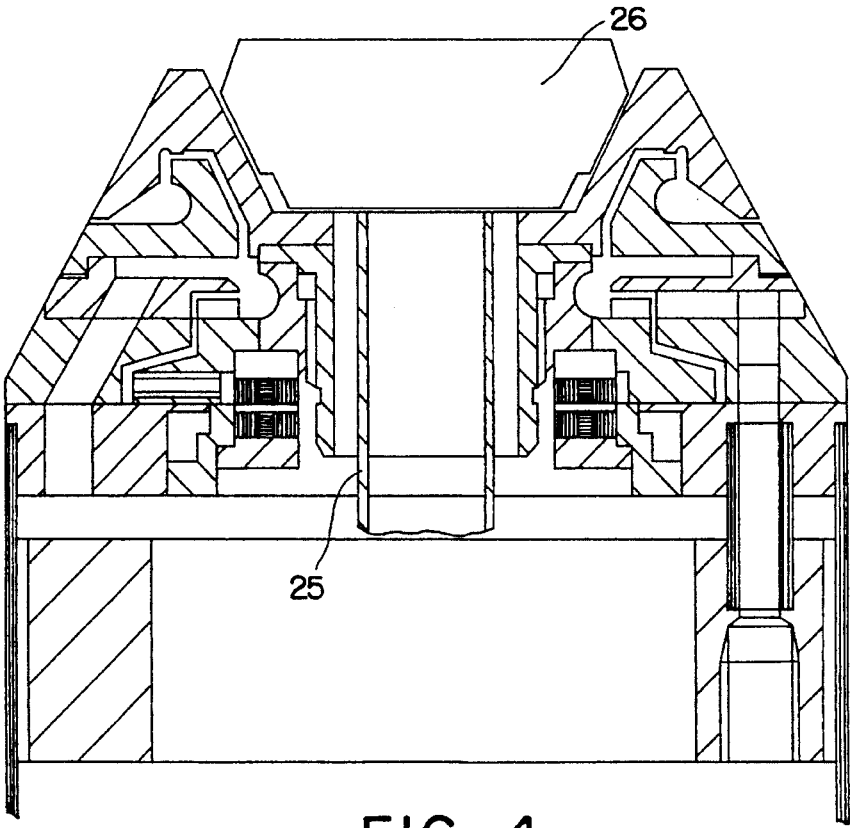
FIG. 4 shows the spray painting nozzle according to the invention with a different type of spray painting unit.

FIG. 4 shows an embodiment of the spray painting nozzle according to the invention corresponding to that according to FIG. 1, wherein there is provided in the supply path 10 for the spray medium a supply tube 25, which extends through the plane **4*a* of the gas bearing and is surrounded by the gas bearing, and to which can be connected different spray painting units 26 of appropriate design for different painting purposes. Here the rotating part 23 comprises a spray painting cup integral therewith, which optionally can be provided with a separate spray painting cup 26**.

Figure 5:
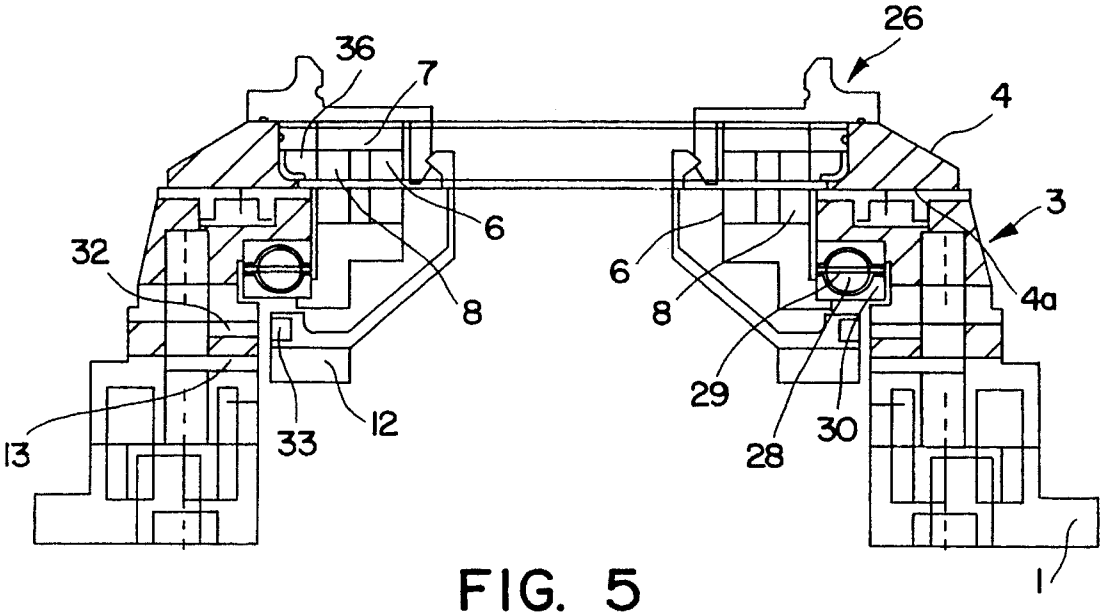
FIG. 5 shows the spray painting nozzle according to an alternative embodiment of the present invention.
Figure 7:
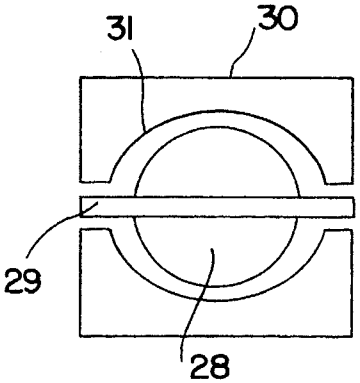
FIG. 7 shows an enlarged, cross-sectional detail of the alternative damping system of FIG. 5.

Referring to FIG. 5, a third alternative embodiment of the present invention is shown, in which like reference numerals refer to like features described above. According to the second alternative embodiment of the present invention, damping is provided by balls 28, preferably governed by a race or cage 29. The balls 28 and cage 29 are housed between two damping rings 30. The rings 30 preferably are made of a hardened, coated material to resist wear. The rings 30 are disposed so as to provide a suspension between the stationary part 3 relative to the supporting structure 1. As illustrated in FIG. 7, the cross-sectional radius of a groove 31 formed on facing inner surfaces of rings 30 is greater than the radius of the balls 28. Accordingly, damping and centering of the stationary part 3 relative to the supporting structure 1 is provided. Further damping could also be provided optionally by supporting the rings 30 with an elastic material, for example, rubber.

Figure 8:
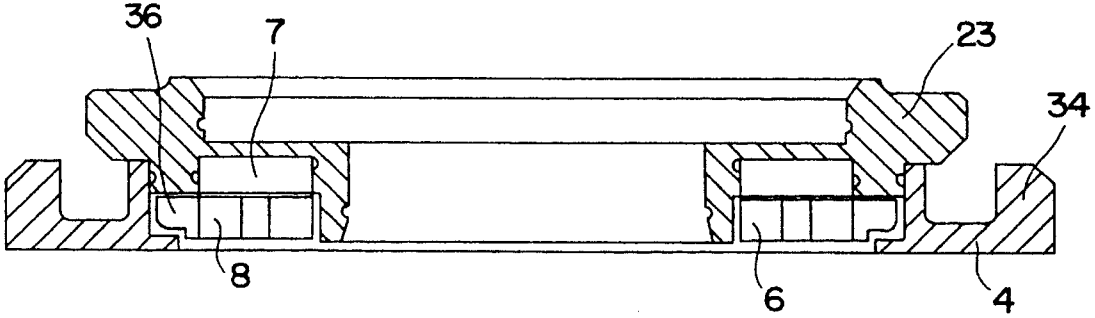
FIG. 8 shows a cross-section of an optional design for the rotor according to an embodiment of the present invention.

Additionally, the present invention optionally comprises a brake device. In the embodiment shown in FIG. 5, the brake device comprises brake nozzles 32. Brake nozzles 32 are directed toward turbine 21 in a direction opposing air inlets 22 such that air directed through brake nozzles 32 slows turbine 21. Optionally, brake nozzles 32 can be directed toward a brake turbine 33 which opposes the direction of rotation created by turbine A further optional feature of the present invention is shown in FIG. 8. At higher rotational speeds at which the present invention will operate, rotor part 4 experiences torsional forces sufficient to cause rotor part 4 to flex and bend. In order to minimize flexing, and to cause the rotor part 4 to bend in a desirable way, the rotor optionally is formed with an extension 34. In addition, a magnet retaining ring 36 surrounds the rotor magnets 6, 8 for reinforcement to prevent disintegration of the magnets which could otherwise occur at high rotational speeds.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A spray painting nozzle comprising:

a spindle comprising a stationary part and a rotatable part, the rotatable part being supported on the stationary part by a gas bearing, the gas bearing comprising mutually plane parallel bearing surfaces formed in the stationary part and in the rotatable part respectively;

a supporting part;

damping means connecting the stationary part to the supporting part, the damping means providing a smooth running of the rotatable part about a center of mass of the rotatable part when a critical rotational speed lower than an intended working speed has been exceeded;

a rotatable spray painting cup adapted to be driven by a drive unit and supported on the rotatable part;

means for supplying a gaseous medium at a pressure between the mutually plane parallel bearing surfaces so as to generate a slot therebetween; and magnet means comprising mutually plane parallel magnets formed in the stationary and in the rotatable parts respectively and substantially co-planar with the gas bearing for guiding the rotatable part radially by exerting a magnetic force so as to center the rotatable part in relation to the stationary part, the magnet means exerting an axial force between the stationary part and the rotatable part so as to limit a width of the slot generated therebetween.

2. The spray painting nozzle of claim 1, wherein the stationary part further comprises a central axial through-channel for supply of a spray medium to a central axial channel in the rotatable part.

3. The spray painting nozzle of claim 1, wherein the rotatable part further comprises turbine blades, and the stationary part further comprises at least one turbine nozzle which supplies a driving medium to the turbine blades for driving the rotatable part.

4. The spray painting nozzle of claim 1, wherein the damping means comprise hollow tubes made of an elastic material and through which the gaseous medium is conducted.

5. The spray painting nozzle of claim 1, further comprising a chamber provided in at least one of each of the gas bearing surfaces, each chamber being provided so as to take up an overpressure prevailing in the gas bearing and adapted during a relative rotation of the bearing surfaces at least once during each rotation through 360° to be brought in communication with at least one opening freely communicating with a surrounding atmosphere, thereby creating pressure shocks intended for indication and recording of a rotational speed.

6. The spray painting nozzle of claim 1, wherein the stationary part and the rotatable part comprise pairs of radially spaced annular magnet means.

7. The spray painting nozzle of claim 6, wherein the magnet means are bridged by magnetic short-circuits.

8. A spray painting nozzle comprising:

a stationary part comprising an annular stationary bearing and an annular stationary magnet, the stationary bearing and the stationary magnet being substantially co-planar;

a rotor rotatably supported on and axially aligned with the stationary part, the rotor comprising an annular rotor bearing facing the stationary bearing and being aligned therewith, and an annular rotor magnet facing the stationary magnet and being aligned therewith, the rotor magnet and the stationary magnet being mutually attracted for magnetically pre-loading the rotor onto the stationary part, the rotor bearing and the rotor magnet being substantially co-planar;

a supporting part;

damping means connecting the stationary part to the supporting part for providing a smooth running of the rotor about a center of mass of the rotor when a critical rotational speed lower than an intended working speed has been exceeded;

channels in the stationary part for directing a gas between the rotor bearing and the stationary bearing, the gas being supplied at a pressure so as to urge the rotor bearing and the stationary bearing apart against the magnetic pre-loading;

an axial through-channel in the stationary part and central to the stationary bearing and the stationary magnet, the axial-through channel being provided for supplying paint to a central axial channel in the rotor;

a cup for receiving the paint, the cup being supported on the rotor; and a turbine connected to the rotor for rotationally driving the rotor.

9. The spray painting nozzle of claim 8, wherein the annular stationary magnet and the annular rotor magnet each comprise pairs of radially spaced annular magnet means.

* * * * *